US005947070A

United States Patent [19]

Immel et al.

[11] Patent Number: 5,947,070

[45] Date of Patent: Sep. 7, 1999

[54] MOLDED PLASTIC CAMSHAFT WITH SEAL RING

[75] Inventors: Thomas A. Immel, Malone; Erik J. Christiansen, Cedarburg, both of Wis.

[73] Assignee: Tecumseh Products Company, Tecumseh, Mich.

[21] Appl. No.: 08/891,053

[22] Filed: Jul. 10, 1997

[51] Int. Cl.[6] ..... F01L 1/053

[52] U.S. Cl. ..... 123/90.6; 123/90.37; 74/567

[58] Field of Search ..... 123/90.27, 90.37, 123/90.6; 74/567; 29/888.1

[56] References Cited

U.S. PATENT DOCUMENTS

| | | | |
|---|---|---|---|
| 3,212,353 | 10/1965 | Chapin | 74/567 |
| 4,562,797 | 1/1986 | Suzuki | 123/90.34 |
| 4,638,683 | 1/1987 | Ogawa | 74/567 |
| 4,644,912 | 2/1987 | Umeha | 123/90.34 |
| 4,826,346 | 5/1989 | Nishiura | 403/267 |
| 4,977,793 | 12/1990 | Husted | 74/567 |
| 5,041,253 | 8/1991 | Husted | 264/251 |
| 5,065,720 | 11/1991 | Nishiyama | 123/363 |
| 5,067,369 | 11/1991 | Taniguchi | 74/567 |
| 5,121,717 | 6/1992 | Simko | 123/90.17 |
| 5,150,674 | 9/1992 | Gracyalny | 123/182.1 |
| 5,172,660 | 12/1992 | Hampton | 123/90.17 |
| 5,172,662 | 12/1992 | Hampton | 123/90.17 |
| 5,215,047 | 6/1993 | Neutgens | 123/90.37 |
| 5,245,888 | 9/1993 | Tsuzuki | 74/567 |
| 5,320,795 | 6/1994 | Mitchell | 264/318 |
| 5,497,679 | 3/1996 | Mitchell | 74/567 |
| 5,797,180 | 8/1998 | Buchholz | 29/888.1 |

*Primary Examiner*—Weilun Lo
*Attorney, Agent, or Firm*—Baker & Daniels

[57] ABSTRACT

An overhead camshaft internal combustion engine having a plastic camshaft which extends through an opening on the cylinder head, the plastic camshaft having a seal ring disposed around the outer surface of the molded plastic camshaft to provide an interface surface for contacting a seal assembly disposed between the engine casing and the molded plastic camshaft. The seal assembly and the seal ring provide a fluid tight seal to prevent leakage of fluid through the cylinder head opening. The seal ring provides a smooth contact surface for the molded plastic camshaft to prevent wear and damage to the seal assembly from the abrasive surface of the molded plastic camshaft. The seal ring also provides a heat sink for dissipating the frictional heat generated by the rotation of the camshaft. In another form, the plastic camshaft includes a powder metal surface formed thereon. The powder metal surface provides the same benefits as the seal ring, namely protection from wear and dissipation of heat. The seal ring or the powder metal surface may advantageously be extended to include the portion of the molded plastic camshaft in contact with a journal bearing.

19 Claims, 2 Drawing Sheets

MOLDED PLASTIC CAMSHAFT WITH SEAL RING

BACKGROUND OF THE INVENTION

1. Field of the Invention

The present invention relates to overhead camshaft internal combustion engines, and more particularly to overhead camshaft internal combustion engines having molded plastic camshafts.

2. Description of the Related Art

Camshafts are used in an overhead camshaft internal combustion engine to control the movement of intake and exhaust valves associated with the combustion chamber. The camshaft is conventionally connected to a crankshaft through a connecting mechanism, such as a sprocket and belt assembly or a gear assembly, and rotates with the crankshaft to coordinate the movement of the intake and exhaust valves during the combustion cycle. Lobes disposed on the camshaft exert axial force on the intake and exhaust valves as the camshaft rotates. The orientation and shape of the lobes on the camshaft control the movement sequence of the intake and exhaust valves.

In some engine configurations, the camshaft is only partially disposed inside the engine cylinder head and extends through an opening on the cylinder head. The portion of the camshaft inside the cylinder head includes cam lobes for operating the intake and exhaust valves and the portion of the camshaft outside the cylinder head includes an assembly for connecting the camshaft with the crankshaft. The camshaft assembly is usually supported by a journal bearing in the cylinder head opening and a seal assembly is disposed between the cylinder head walls and the camshaft to provide a fluid tight seal between the camshaft surface and the cylinder head opening. The seal assembly usually includes a tip portion made of rubber or other similarly flexible material, which is in contact with the camshaft surface. The rubber tip portion in combination with the camshaft surface forms a fluid barrier for minimizing fluid leakage between the cylinder head opening and the camshaft surface.

Conventionally, the camshaft and the cam lobes thereon are formed of metallic materials. However, camshafts formed of metallic materials can be relatively difficult and costly to manufacture. The manufacture of the camshaft itself as well as the cam lobes requires precision machining equipment and methods. Also, the cuttiing of the camshaft to form cam lobes results in scrap material which is wasted. Thus, the requirement of precision machining and the relatively high cost of the metallic materials raise the cost of manufacturing metallic camshafts.

Manufacturing camshafts from molded plastic material is one alternative to manufacturing camshafts from metallic materials. There are a number of advantages associated with using a molded plastic camshaft. Plastic camshafts can be easily molded from relatively inexpensive materials using conventionally known techniques. Such molded plastic camshafts are easily manufactured since expensive precision machining equipment and methods are not required. Plastic camshafts are also lighter in weight than metallic camshafts. The lighter weight eases manufacturing requirements as well as handling of the finished product by the end user. Further, plastic camshafts operate more quietly than camshafts formed of metallic materials.

However, a problem associated with using plastic camshafts in the configuration where the camshaft extends through a cylinder head opening is the difficulty in maintaining a tight fluid seal at the interface between the engine cylinder head and the plastic camshaft surface. A plastic camshaft surface is relatively abrasive compared to the soft plastic material used at the tip portion of the seal assembly. Therefore, as the plastic camshaft rotates at high speed, the abrasive camshaft surface destroys the rubber tip portion of the seal in a relatively short period of time resulting in the loss of the fluid tight seal. Also, since the abrasive surface is not uniformly in contact with the rubber tip portion, the contact between the rubber tip portion and the camshaft surface initially produces a lower quality seal.

Additionally, plastic is not a good heat sink and is unable to easily dissipate the frictional heat generated by the rotational contact between the plastic camshaft and the seal assembly. The inability to dissipate the frictional heat results in a heat build up in the plastic camshaft. The heat build up may be high enough to damage both the plastic camshaft and the seal assembly, such as by warping, melting, etc.

Therefore, what is needed is a plastic camshaft for use in an internal combustion engine which provides a smooth contact surface and the qualities of good heat dissipation and durability to ensure that the plastic camshaft and associated components, such as the seal assembly, do not wear out under high heat and wear conditions, and thereby maintain a tight fluid seal between the cylinder head opening and the plastic camshaft.

SUMMARY OF THE INVENTION

The present invention comprises an overhead camshaft internal combustion engine having a cylinder head, a plastic camshaft disposed partially inside the cylinder head and extending through an opening on the cylinder head, an interface surface disposed around the plastic camshaft, and a seal assembly disposed about the interface surface of the plastic camshaft, adjacent the cylinder head opening, to provide a fluid tight seal between the cylinder head opening and the plastic camshaft. The interface surface around the plastic camshaft shields the abrasive surface of the plastic camshaft from the surfaces of the seal assembly thereby protecting the relatively soft rubber surfaces of the seal assembly from wear to maintain a fluid tight seal between the cylinder head opening and the plastic camshaft. The interface surface may be formed of any suitable material, such as steel, which can provide a smooth contact surface. A metallic interface surface also provides a mechanism for dissipating the frictional heat generated by the rotation of the plastic camshaft inside the seal assembly.

In one form thereof, the interface surface comprises a metal seal ring disposed around the plastic camshaft and in contact with a seal assembly and/or a journal bearing.

In another form thereof, the interface surface comprises a powder metal surface formed around the plastic camshaft and in contact with a seal assembly and/or a journal bearing.

The metal seal ring or powder metal surface may be extended along the length of the plastic camshaft as desired to surround any portion of the plastic camshaft which contacts an engine component wherein wear and/or heat build-up is a concern.

An advantage of the present invention is that an interface surface comprising a metal seal ring or powder metal surface provides a smooth contact surface to shield the abrasive surface of the plastic camshaft against relatively softer material to protect the softer material from wear.

Another advantage of the present invention is that the smooth surface of the interface surface comprising a metal seal ring or powder metal surface enhances the fluid tight barrier formed by the plastic camshaft and the seal assembly.

Another advantage of the present invention is that an interface surface comprising a metal seal ring or powder metal surface provides a mechanism for dissipating the frictional heat generated by the rotation of the plastic camshaft inside the seal assembly or other engine casing components. The ability to dissipate heat protects the plastic camshaft and the contact components from bending, warping, melting, and other problems associated with heat build-up.

BRIEF DESCRIPTION OF THE DRAWINGS

The above-mentioned and other features and advantages of this invention, and the manner of attaining them, will become more apparent and the invention will be better understood by reference to the following description of the embodiments of the invention taken in conjunction with the accompanying drawings, wherein.

Corresponding reference characters indicate corresponding parts throughout the several views. The exemplifications set out herein illustrate embodiments of the invention, in several forms, and such exemplifications are not to be construed as limiting the scope of the invention in any manner.

DETAILED DESCRIPTION OF THE INVENTION

The embodiments described below are not intended to be exhaustive or limit the invention to the precise forms disclosed in the following detailed description.

Figure 1:
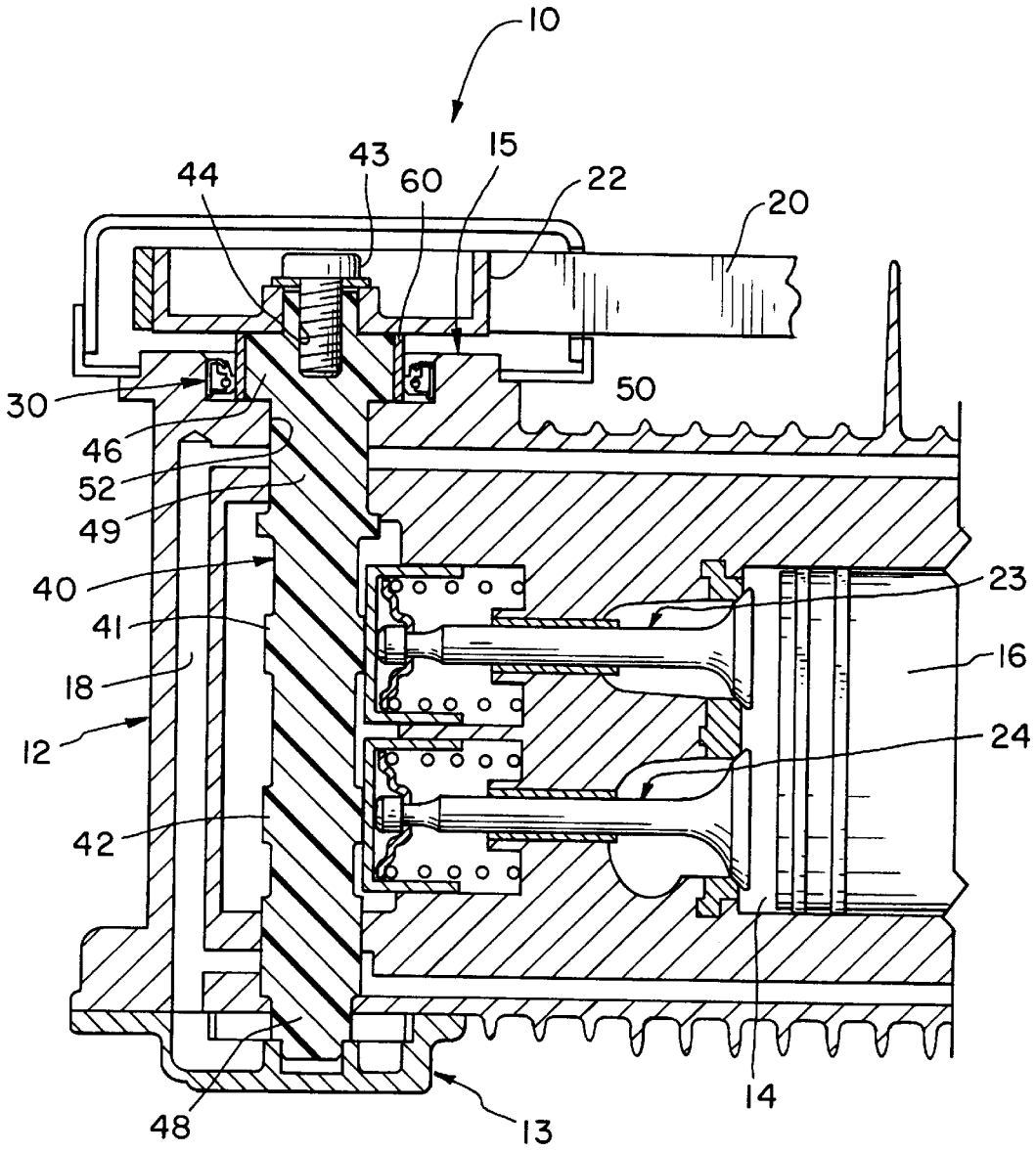
FIG. 1 is a partial, cross-sectional view of an overhead camshaft internal combustion engine having a plastic camshaft with a metal seal ring disposed thereon.

Referring to the drawings, FIG. 1 illustrates an internal combustion engine having an overhead camshaft assembly adapted to control the movement of the intake and exhaust valves associated with a combustion chamber. Internal combustion engine 10 comprises cylinder head 12 having combustion chamber 14 disposed therein. Piston 16 is disposed inside combustion chamber 14 and moves axially in response to the combustion occurring therein. Valve assemblies 23 and 24 open and close a flow path for the combustion air and exhaust air to combustion chamber 14 during the combustion cycle. The movement of valve assemblies 23 and 24 is controlled by camshaft 40. As camshaft 40 rotates, cam lobes 41 and 42 contact and move valve assemblies 23 and 24. The rotation of camshaft 40 is in turn controlled by belt assembly 20 which is connected to piston 16 by a crankshaft assembly (not shown) via cam sprocket 22, bore 44 and threaded fastener 43. Oil passages 18 are formed inside cylinder head 12 to provide the flowpath for oil to provide the necessary lubrication for the internal components.

Camshaft 40 is made of a suitable plastic material having sufficient durability characteristics. Such materials include, but are not limited to, a thermoset, such as Fiberite FM-4017F manufactured by Fiberite of Winona, Minn., and a thermoplastic, such as Nylon 6/6 impact modified with 17% glass fill and Nylon 6/6 impact modified without glass fill.

As further shown in FIG. 1, camshaft 40 is partially disposed inside cylinder head 12 and extends out through opening 50 of cylinder head 12. Camshaft 40 includes end portion 46 which is disposed outside cylinder head 12 and shaft portion 49 which is disposed in cylinder head opening 50. End portion 48 is opposite end portion 46 and disposed adjacent sealed end 13 of cylinder head 12. Journal bearing 52 contacts and supports the surface of camshaft 40 at opening 50.

As camshaft 40 extends out of cylinder head 12, a sealing mechanism is required to prevent the leakage of fluid between the surface of camshaft 40 and cylinder head opening 50. Seal assembly 30 is disposed around camshaft 40 and abuts cylinder head 12 at open end 15 to provide the fluid tight seal between the surface of camshaft 40 and cylinder head opening 50.

Figure 2:
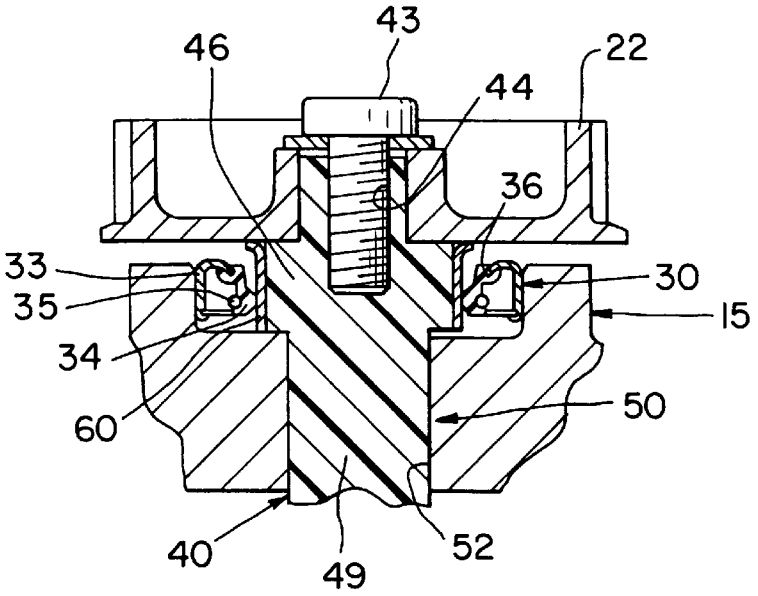
FIG. 2 is an enlarged, fragmentary cross-sectional view of FIG. 1.
Figure 3:
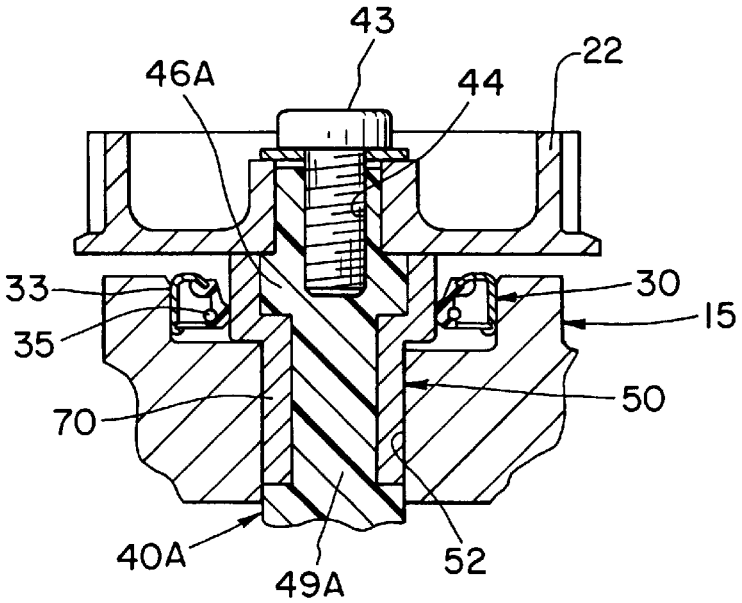
FIG. 3 is an enlarged, fragmentary cross-sectional view of an overhead camshaft internal combustion engine having a plastic camshaft showing an alternative embodiment of the interface surface.

As particularly shown in FIGS. 2–3, seal assembly 30 includes tip portion 34 which contacts a surface on camshaft 40 to provide a fluid tight seal between tip portion 34 and camshaft 40. In this case tip portion 34 contacts either metal seal ring 60 or powdered metal surface 70 as described further below. Seal assembly 30 comprises metal ring 33, which is in fixed contact with a surface of open end portion 15 such that camshaft 40 can rotate inside seal assembly 30. Metal ring 33 is connected to tip portion 34 at connection 36. Tip portion 34 is disposed on the inner portion of seal assembly 30 and is of flexible construction to follow the contours of the surface against which tip portion 34 is seated. Garter spring 35 is disposed inside seal assembly 30 and around tip portion 34 to urge seal tip portion 34 tightly against a surface of camshaft 40.

It is to be understood that the present invention is not limited to a particular seal assembly configuration and that any conventional seal assembly configuration which includes a flexible tip portion in contact with camshaft 40 to provide a seal and allows the rotation of camshaft 40 therein may be used. Tip portion 34 may be formed of any suitable elastomeric material having sufficient flexible characteristics. Such materials are typically synthetic rubber material and include, but not limited to, nitrile, polyacrylate, and fluorocarbon elastomers.

FIG. 2 is an enlarged cross-sectional view of the present camshaft showing the details 6f camshaft 40 around seal assembly 30. Camshaft 40 extends through cylinder head opening 50 and includes camshaft portion 49 which is disposed in cylinder head opening 50 and camshaft portion 46 which is disposed outside cylinder head 12. Journal bearing 52 contacts and supports camshaft portion 46. The contact between the surfaces of journal bearing 52 and camshaft portion 46 forms a fluid barrier to prevent some leakage of fluid through cylinder head opening 50. However, as described further below, the primary fluid barrier is formed by the contact between camshaft 40 and seal assembly 30.

Camshaft portion 46 includes seal ring 60 disposed around the outer surface thereof. Seal ring 60 contacts tip portion 34 of seal assembly 50 to form a fluid tight seal around camshaft 40. Seal ring 60 may be formed of any suitable material having sufficient durability, smooth surface, and heat dissipation characteristics. Such materials include, but is not limited to, iron and carbon steel. Preferably, the material should have a Rockwell hardness of about B96 minimum. The material may also be chrome plated for wear and finish resistance. The surface finish should be less than about 10–20 micro inches $R_a$. Such material will provide adequate hardness, smoothness and heat dissipating capabilities to protect seal assembly 30 and camshaft 40.

The placement of seal ring 60 around camshaft portion 46 advantageously provides a smooth contact surface between tip portion 34 and camshaft portion 46. The smooth contact surface of seal ring 60 protects the relatively soft material of tip portion 34 from the abrasive surface of camshaft 40 thereby preventing the destruction of tip portion 34 to the rotational contact with camshaft 40. Further, seal ring 60 provides a heat sink for dissipating the frictional heat generated by the rotation of camshaft 40 against tip portion 34 during normal operation. The dissipation of heat through seal ring 60 reduces the build-up of heat in camshaft 40 and thereby reduces the likelihood of warping, melting, or distortion of camshaft 40.

It is to be understood that although only the portion of camshaft 40 adjacent seal assembly 30 and cylinder head opening 50 includes seal ring 60, similar seal rings may be placed on any portion of camshaft 40 in contact with a sealing device or an engine component to provide the benefits described above.

An alternative embodiment of the present invention is shown in FIG. 3. As in the first embodiment, camshaft 40A includes camshaft portion 49A which is disposed in cylinder head opening 50 and camshaft portion 46A which is disposed outside cylinder head 12. In the alternative embodiment, camshaft 40A includes powder metal surface 70 which is formed onto the surface of camshaft 40A so as to form a seal ring. It is to be understood that powder metal surface 70 may be formed of any suitable material which may be formed on the surface of camshaft 40A and has good durability, smooth surface and heat dissipating characteristics. Such material may include, but is not limited to FC-0508-50 (iron-copper steel) with about 6.5 G/cc density and F-0000 (iron & carbon steel). Again powder metal surface 70 has a surface finish of less than about 10–20 micro inches $R_a$ to provide sufficient smoothness.

Again, seal assembly 30 is disposed around camshaft portion 46A and contacts powder metal surface 70 to provide a fluid tight seal around cylinder head opening 50. Powder metal surface 70 provides the same benefits associated with seal ring 60, namely wear protection for seal assembly 30 by providing an interface surface between the abrasive surface of plastic camshaft 40 and tip portion 34, as well as heat dissipation capability. The smooth surface of powder metal surface 70 also enhances the fluid tight seal formed by the contact between tip portion 34 and powder metal surface 70. In this case, since powder metal surface 70 is formed onto camshaft 40A, the need for an additional component, namely, seal ring 60, to be manufactured and placed around camshaft 40A is obviated. Thus, forming powder metal surface 70 directly onto camshaft 40A further eases manufacturing and assembly of the plastic camshaft assembly.

Further, powder metal surface 70 is also formed around camshaft portion 49A to form an interface surface which contacts the surface of journal bearing 52. The extension of powder metal surface 70 provides similar benefits at the portions of camshaft 40A in contact with journal bearing 52. Again, powder metal surface 70 may be extended to other portion of camshaft 40A as desired.

During normal operation, camshafts 40, 40A may rotate at relatively high speeds inside seal assembly 30 and journal bearing 52. However, the provision of seal ring 60 or powder metal surface 70 forming a seal ring around the portions of camshaft 40, 40A which contact seal assembly 30 and/or journal bearing 52 protects the surface seal assembly 30, dissipates the frictional heat generated, and enhances the fluid tight seal.

While this invention has been described as having a preferred design, the present invention can be further modified within the spirit and scope of this disclosure. This application is therefore intended to cover any variations, uses, or adaptations of the invention using its general principles. For example, it is to be understood that the present invention may advantageously be used with a variety of seal assemblies wherein the plastic camshaft surface contacts a tip portion made of rubber or other similar material. Further, this application is intended to cover such departures from the present disclosure as come within known or customary practice in the art to which this invention pertains and which fall within the limits of the appended claims.

What is claimed is:

1. An overhead camshaft internal combustion engine, comprising:

a cylinder head having a combustion chamber and a valve assembly disposed therein, said cylinder head having an opening;

a plastic camshaft extending through said cylinder head opening and contacting said valve assembly, said plastic camshaft including cam lobes to rotationally control the operation of said valve assembly;

a seal ring disposed around said plastic camshaft adjacent said cylinder head opening, said seal ring having an interface surface; and a seal mounted on said cylinder head and disposed around said seal ring, said seal having a seal element in contact with said interface surface, whereby said seal element and said interface surface form a fluid tight seal to prevent leakage of fluid through said cylinder head opening.

2. The overhead camshaft internal combustion engine according to claim 1, wherein said seal element comprises a relatively soft, rubbery material.

3. The overhead camshaft internal combustion engine according to claim 1, wherein said seal ring is formed of a metallic material.

4. The overhead camshaft internal combustion engine according to claim 3, wherein said metallic material has a Rockwell hardness of at least B96.

5. The overhead camshaft internal combustion engine according to claim 3, wherein said metallic material has a surface smoothness less than 20 micro inches $R_a$.

6. The overhead camshaft internal combustion engine according to claim 5, wherein said metallic material is chrome plated to a smoothness of less than 20 micro inches $R_a$.

7. The overhead camshaft internal combustion engine according to claim 1, wherein said plastic camshaft is formed of thermoset material.

8. The overhead camshaft internal combustion engine according to claim 1, wherein said plastic camshaft is formed of thermoplastic material.

9. The overhead camshaft internal combustion engine according to claim 1, wherein said cylinder head comprises a journal bearing, said plastic camshaft extends through said journal bearing, said seal ring is disposed around portions of said plastic camshaft disposed in said journal bearing and in contact with said seal element.

10. An overhead camshaft internal combustion engine, comprising:

a cylinder head having a combustion chamber and a valve assembly disposed therein, said cylinder head having an opening;

a plastic camshaft extending through said cylinder head opening and contacting said valve assembly, said plastic camshaft including cam lobes to rotationally control the operation of said valve assembly, said plastic camshaft having a powder metal surface formed thereon adjacent said cylinder head opening; and a seal disposed around said powder metal surface and in fixed contact with said cylinder head, said seal having a seal element in contact with said powder metal surface, whereby said seal element and said powder metal surface form a fluid tight seal to prevent leakage of fluid through said cylinder head opening.

11. The overhead camshaft internal combustion engine according to claim 10, wherein said seal element comprises a relatively soft, rubbery material.

12. The overhead camshaft internal combustion engine according to claim 11, wherein said seal element is formed of a suitable synthetic elastomer.

13. The overhead camshaft internal combustion engine according to claim 10, wherein said powdered metal surface is formed of iron-copper steel.

14. The overhead camshaft internal combustion engine according to claim 10, wherein said powder metal surface is formed of carbon steel.

15. The overhead camshaft internal combustion engine according to claim 14, wherein said powder metal surface has a surface smoothness less than 20 micro inches $R_a$.

16. The overhead camshaft internal combustion engine according to claim 10, wherein said plastic camshaft is formed of thermoset material.

17. The overhead camshaft internal combustion engine according to claim 10, wherein said plastic camshaft is formed of thermoplastic material.

18. The overhead camshaft internal combustion engine according to claim 10, wherein said cylinder head comprises a journal bearing, said plastic camshaft extends through said journal bearing, said powder metal surface is disposed around portions of said plastic camshaft disposed in said journal bearing and in contact with said seal element.

19. The overhead camshaft internal combustion engine according to claim 1 wherein said seal ring is formed of powder metal.

* * * * *

UNITED STATES PATENT AND TRADEMARK OFFICE

CERTIFICATE OF CORRECTION

PATENT NO. : 5,947,070

DATED : September 7, 1999

INVENTOR(S) : Thomas A. Immel et, al.

It is certified that error appears in the above-identified patent and that said Letters Patent is hereby corrected as shown below:

On the title page, item [54], and column 1, line 1:

IN THE TITLE

After "WITH" insert --METAL--

Signed and Sealed this

Twenty-second Day of February, 2000

*Attest:*

Q. TODD DICKINSON

*Attesting Officer*

*Commissioner of Patents and Trademarks*